United States Patent [19]

Takano et al.

[11] 3,952,816

[45] Apr. 27, 1976

[54] DRILLING SYSTEM AND METHOD OF PULLING IT UP

[75] Inventors: Sho Takano; Yasushi Okuyama, both of Tokyo; Ryokuya Suzuki, Kunitachi, Japan; Ikuma Kinoshita, Chigasaki, all of Japan

[73] Assignee: Sumitomo Metal Mining Company Limited, Tokyo, Japan

[22] Filed: Sept. 23, 1974

[21] Appl. No.: 508,459

Related U.S. Application Data

[62] Division of Ser. No. 406,482, Oct. 15, 1973, Pat. No. 3,894,590.

[52] U.S. Cl. ..... 175/67; 175/103; 175/107; 175/203

[51] Int. Cl.[2] ..... E21B 7/18; E21B 3/12

[58] Field of Search ..... 175/57, 99, 107, 103, 175/202, 203, 258–261, 67

[56] References Cited

UNITED STATES PATENTS

| | | | |
|---|---|---|---|
| 2,016,067 | 10/1935 | Bannister | 175/103 |
| 2,865,602 | 12/1958 | Whittle | 175/107 |
| 3,036,646 | 5/1962 | Eckel et al. | 175/107 |
| 3,077,937 | 2/1963 | Tirespolsky et al. | 175/107 |
| 3,353,612 | 11/1967 | Bannister | 175/103 X |

*Primary Examiner*—David H. Brown
*Attorney, Agent, or Firm*—Watson, Cole, Grindle & Watson

[57] ABSTRACT

A drilling system includes a drill pipe and a cutting means located therein. A locking mechanism with said drill pipe is provided on said cutting means and is operatively connected with a spearhead engageable with an engaging mechanism of a pulling-up device so that, when the spearhead is pulled, an inner tube and outer tube forming a part of the locking mechanism may move relative to each other to unlock the drill pipe and cutting means for quickly and easily pulling up the latter.

2 Claims, 29 Drawing Figures

DRILLING SYSTEM AND METHOD OF PULLING IT UP

This is a division of application Ser. No. 406,482 filed Oct. 15, 1973, now U.S. Pat. No. 3,894,590.

This invention relates to drilling systems to be used to dig deep wells for collecting petroleum or underground water or to investigate the ground by collecting geological samples. Drilling systems are known making use of diamond grain bits or gear-shaped bits having superhard teeth. The bit is normally directly connected with a hydraulic motor such as a turbine, and is integrally formed at the tip of a drill pipe so that it can be driven directly by the hydraulic motor to dig and cut the ground without rotating the drill pipe. There is also known a drilling system wherein a core barrel inner tube for containing a geological sample is inserted through a drill pipe from the ground surface side of the drill pipe, can be locked at the ground side end of the drill pipe, is connected with a pulling-up tool inserted through the drill pipe from the ground surface side and can be pulled up on the ground surface through the drill pipe while leaving the drill pipe in the ground after being unlocked from the drill pipe.

In order to cut a column of a geological sample out of the ground, the ground layer is removed as a column into a pipe by using a cylindrical bit. In order to take such a core (geological sample) out on the ground, the entire drill pipe normally had to be pulled up on the ground surface. However, with an increase of the depth of the bore, more time is needed to pull up and reinsert the drill pipe. Therefore, in a drilling system wherein a core collecting tube is inserted into the tip of a drill pipe, a core is made to enter this core collecting tube so that said core collecting tube can be connected with a wire inserted through the drill pipe and can be pulled up on the ground surface while leaving the drill pipe in the ground as it is, or the core collecting tube is fed by water under pressure into the drill pipe inserted into the ground as it is and can be locked in the tip of the drill pipe, as disclosed in Japanese Patent Publication No. 642/1969.

Further, if the bit is fitted directly to the tip of the drill pipe, when the bit has worn thereby reducing the boring velocity, in order to replace the bit, the entire drill pipe must be taken out on the ground surface. Therefore, there has been developed a drilling system wherein a bit is fitted to a bit fitting bar adapted to be fitted within a drill pipe and is projected out of the tip of the drill pipe to drill the ground.

For locking the part fitted to the tip of the drill pipe in place, a pin is passed through the pipe diameter at the upper end of the core collecting tube or bit fitting bar and two scissors-like latches are pivoted onto the pin so as to be directed upwardly of the ground surface side. A spring projects the latches at their other ends out of a window formed parallel to the axial direction of an outer cylinder capable of movement only within a certain range in an axial direction to the fitting bar on the outer periphery of the upper end of the fitting bar. The latches are fitted within a vertical groove provided on the inner surface of the drill pipe to prevent them from rising by the upper side surface of the vertical groove. In order to positively keep the latch locked, a square pin is provided on the pipe diameter of the outer cylinder so as to be movable up and down parallel to the pin in a window provided axially of the outer cylinder so that, by setting the pin between the two latches, the latches may be closed with respect to each other and may be prevented from coming out of the vertical groove.

In order to disengage the drill pipe and latch with each other and to pull them up on the ground, when a chuck or hook connected with a wire is lowered through the drill pipe, the chuck or hook is connected with a spearhead formed in the top part of the outer dylinder and the wire is pulled up. The outer cylinder will rise and the pin supported by the outer cylinder will come out upwardly between the two latches and, when the outer cylinder further rises, the latch will be pulled inside the outer cylinder by the lower edge of the window and will be disengaged from the vertical groove.

Thus, in the conventional locking device, as the pin which prevents the latch from closing and the pin which holds the latch are on the pipe diameter of the outer cylinder, only two latches on the right and left can be provided and therefore, when transmitting a torque and thrust from the drill pipe through the latches to a bit fitted to the lower end of the fitting bar, the transmitting surface cannot be made larger for the transmission of larger forces.

Further, in the above mentioned type, unless the entire drill pipe is taken out on the ground, the bit will not be able to be replaced.

Also, in the known type, it has often been noted that the reaming bit is closed during digging and the provision of only a few number of reaming bits is made possible.

For a deep well, considerable time is required if the entire drill pipe must be pulled out of and inserted back into the ground for the taking of a geological sample. Therefore, a system has been developed wherein a device (core barrel inner tube device) which can grip a geological sample within the drill pipe from the underground side end of the drill pipe is inserted into the drill pipe and is locked at the underground side end of the drill pipe so that a geological sample may enter said device. A chuck or hook (overshot) connected to a wire is inserted into the drill pipe from the ground surface and the core barrel inner tube device is connected to the wire through the overshot so that the wire may be pulled up to pull up the geological sample on the ground surface out of the drill pipe. (See the above mentioned publication of Japanese Patent Publication No. 642/1969). The present inventors have developed also a drilling system wherein drilling bits and reaming bits can be inserted into a drill pipe, can be locked at the underground side end of the drill pipe and can be also pulled up out of the drill pipe so as to be replaced or repaired.

For carrying out a drilling operation by using such a drilling system, water is fed under pressure to the drilling bits and reaming bits through the drill pipe, the water is returned to the ground surface through the outside of the drill pipe in order to cool the friction heat generated when the bits and reaming bits cut the ground layer, and then discharges the earth and sand out by the bits and reaming bits onto the ground surface.

When the water fed into the bore from the ground surface is absorbed by the ground layer and the water fed into the drill pipe is cut off, the water in the drill pipe will be exhausted in some cases. Therefore, when the bore is directed downwardly, if the cutting part having the bits or reaming bits is inserted into an empty drill pipe, it will drop through the drill pipe under the force of gravity and will collide with the locking part provided inside the underground side end of the drill pipe so severely as to cause breakage. Therefore, it should be connected with a wire and be thereby suspended.

On the other hand, if there is water in the drill pipe, this water will produce such a high resistance that the cutting part will not drop at a desirable velocity through the drill pipe only under the force of gravity and will not be positively locked at the underground side end of the drill pipe. Therefore, the cutting part is fed into the underground side end of the drill pipe by effecting the needed velocity or by using water under pressure against the force of gravity during an upward drilling operation. When the drill pipe is filled with water inside and outside, if the cutting part is to be pulled up to the ground surface through the drill pipe, should it be pulled up quickly, the water filling the outside of the drill pipe will not be able to follow the lower side of the rising cutting part. A vacuum will be produced below the cutting part and the bore wall will be pulled into the vacuum to cause an accident such as the collapse of the bore wall. The thus produced vacuum will also add a large load to the winding up operation and, further, the entire weight of the water above the cutting part will be applied to the winder and therefore a large motive force will be required for the winding up operation. Therefore, the velocity during pulling up of the cutting part onto the ground, that is, the recovering velocity, has been considerably restricted and, even in the drilling system, by such a wire line system in which no drill pipe is inserted and taken out, the pulling up operation of the the cutting part being thereby made time consuming.

Therefore, the principal object of the present invention is to provide a drilling system wherein the above mentioned defects are eliminated.

Another object of the present invention is to provide a locking device for a drilling system wherein a number of latches required for the transmission of forces can be provided, water can be fed along the center of the locking device, the strength of the latch can be made larger and the failure to set the latch can be prevented.

A further object of the present invention is to provide a drilling system wherein the bit can be held so as not to sway with respect to the drill pipe, and the drilling direction can be accurately regulated.

Another object of the present invention is to provide a drilling system wherein the reaming bits can be positively maintained in an expanded condition during digging.

Still another object of the present invention is to provide a reaming bit fitting structure for a drilling system wherein the number of fitted reaming bits can be increased.

Another object of the present invention is to provide a method and device for pulling up a cutting part wherein the cutting part of the above mentioned drilling system can be pulled up at a high speed.

IN THE DRAWINGS

FIGS. 1 to 6 show one embodiment in half-section of the present invention wherein a cutting part is locked at the underground side of a drill pipe and pressure water is fed into drill pipe during drilling, it being understood that the part B—B in FIG. 2 is to follow the part A—A in FIG. 1, the part D—D in FIG. 3 is to follow the part C—C in FIG. 2, the part F—F in FIG. 4 is to follow the part E—E in FIG. 3, the Part H—H in FIG. 5 is to follow the part G—G in FIG. 4 and the part J—J in FIG. 6 is to follow the part I—I in FIG. 5;

Figure 13A:
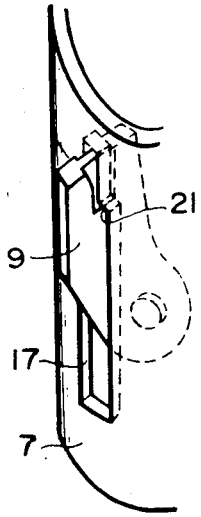
Figure 14:
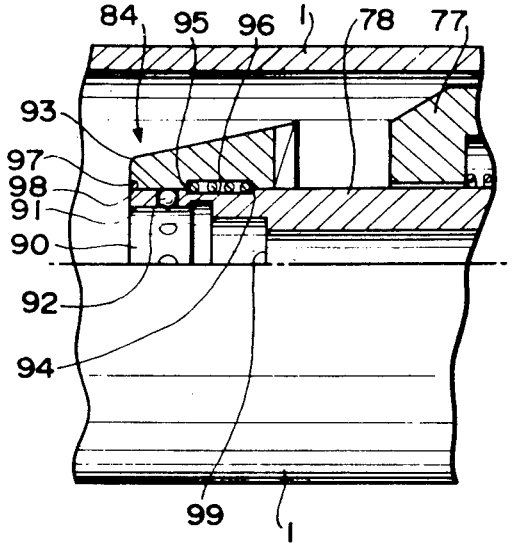
Figure 15:
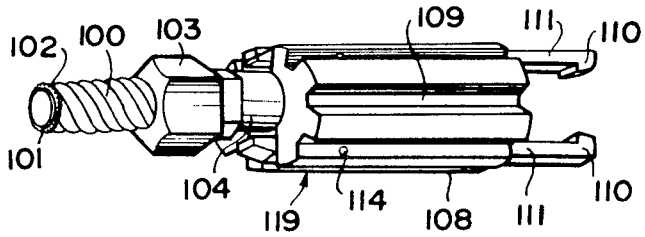
Figure 16:
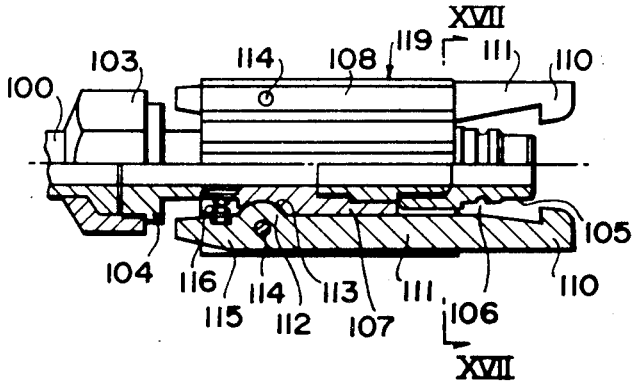
Figure 17:
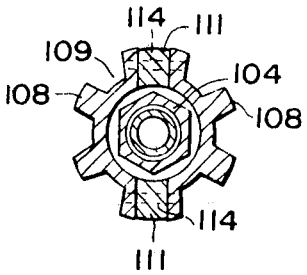
Figure 18:
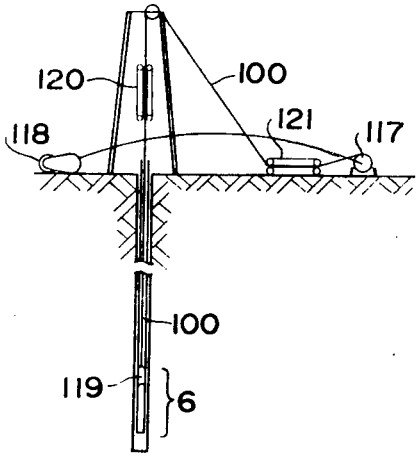
Figure 19:
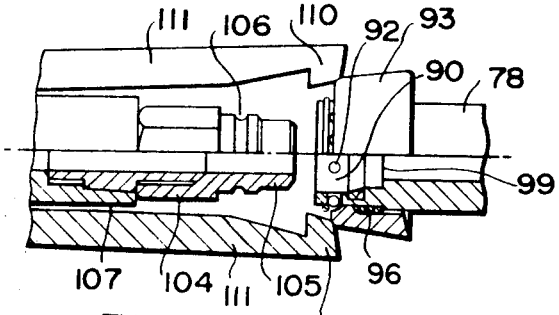
Figure 20:
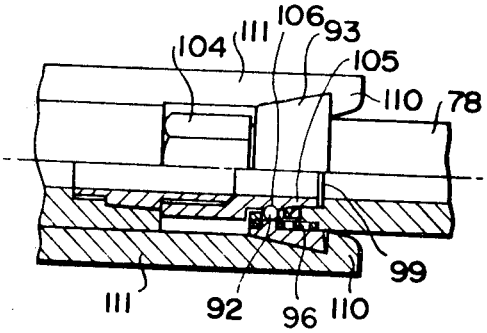
Figure 21:
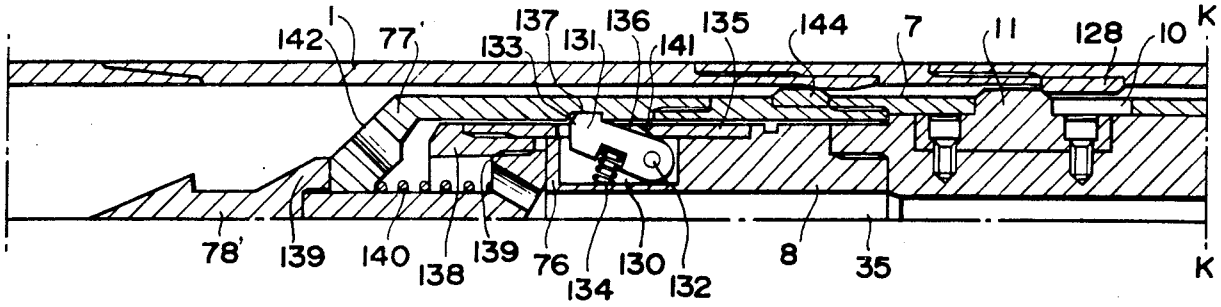
Figure 22:
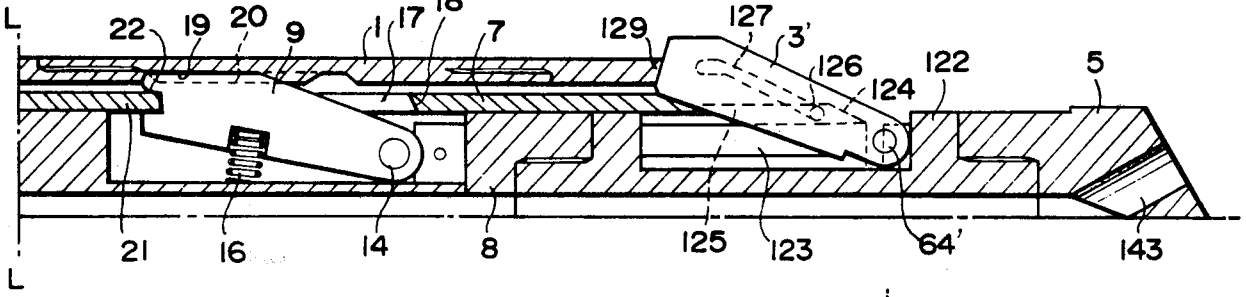
Figure 23:
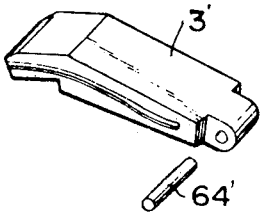
Figure 24:
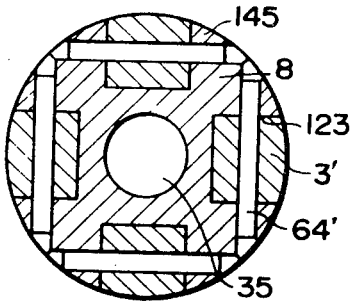
Figure 25:
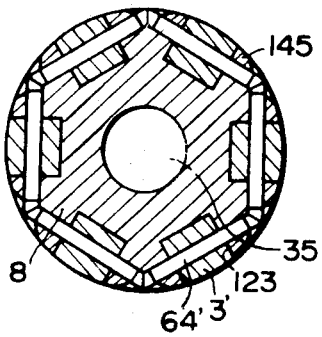
Figure 26:
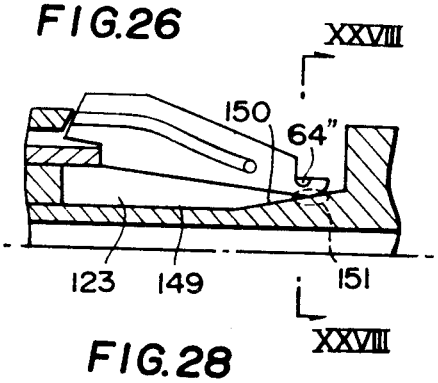
Figure 27:
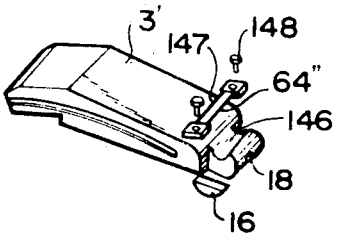
Figure 28:
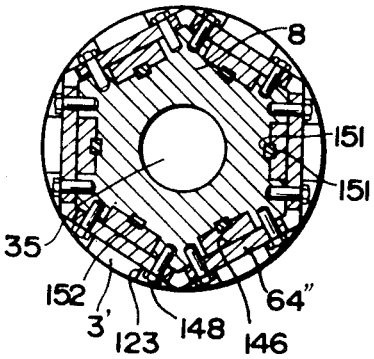

FIGS. 13*a* and *b* are perspective views showing the relation of a latch and outer cylinder;

FIG. 14 is a vertically sectioned view showing a spearhead part of a drilling system according to the present invention;

FIG. 15 is a perspective view of an overshot;

FIG. 16 is a half-sectioned side view of the overshot shown in FIG. 15;

FIG. 17 is a cross-sectional view taken along line XVII—XVII of FIG. 16;

FIG. 18 is a side elevational view illustrating the method of pulling up a drilling system according to the present invention;

FIGS. 19 and 20 are vertically sectional views showing the connection of the overshot and spearhead;

FIGS. 21 and 22 form a single showing of a vertically half-sectioned view of a drilling system according to another embodiment of the present invention it being understood that part K—K in FIG. 21 is to be connected to the part L—L in FIG. 22;

FIG. 23 is a perspective view of the reaming bit and pin shown in FIG. 22;

FIG. 24 is a cross-sectional view taken along line XXIV—XXIV of FIG. 22;

FIG. 25 is a view similar to FIG. 24 showing a slight variation;

FIG. 26 is a half-sectioned view showing an embodiment of the bit fitting part of a drilling system of the present invention;

FIG. 27 is a disassembled perspective view showing a reaming bit with a pin, key and screws; and FIG. 28 is a cross-sectional view taken along line XXVIII—XXVIII of FIG. 26.

In FIGS. 1 to 10, 1 is a drill pipe shown in phantom outline, 2 is a cutting bit, 3 is a reaming bit, 4 is a hydraulic motor, 5 is a locking mechanism, 88 is a water passage opening and closing mechanism, 6 is a cutting part having the parts 2 to 5 and 88 and as locked at the underground side end of the drill pipe 1.

Figure 2:
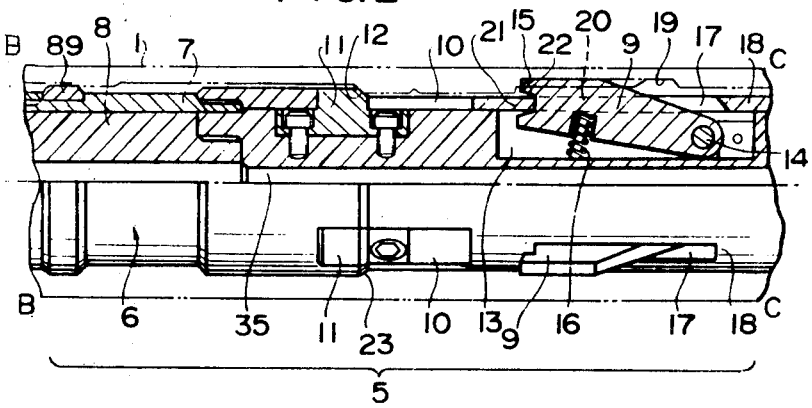

The locking mechanism 5 principally comprises an outer cylinder 7, an inner cylinder 8 and latches 9 as shown in FIG. 2. The outer cylinder 7 is provided for relative axial movement on the outer periphery of inner cylinder 8 and is disposed within drill pipe 1. The outer cylinder 7 is provided with windows 10 extending in an axial direction, and a convex part 11 provided on inner cylinder 8 projects outwardly of outer cylinder 7 through this window 10. Convex part 11 is axially movable along window 10 to effect an opening and closing of latch 9 in a manner to be hereinafter described.

An annular stepped part 12 is formed on the inner surface of pipe 1 near the underground side end thereof so that, when convex part 11 contacts stepped part 12, inner cylinder 8 is prevented from further advancing toward the underground side within the drill pipe 1.

An opening 13 is provided in cylinder 8 forwardly of part 11, and plate-shaped latches are located in this opening. Each latch 9 is mounted for pivotal movement at its forward end about a pin 14 located within opening 13, and is urged outwardly at its other end 15 about pin 14 by means of a spring 16 disposed between the bottom of the opening and each latch 9.

A window 17 is provided in outer cylinder 7 for each latch so that, when outer cylinder 7 moves axially toward the ground surface side (leftward in FIG. 2) relative to inner cylinder 8, each latch 9 will be urged at its side edge by lower edge 18 of the window 17 into opening 13. Conversely, when outer cylinder 7 moves toward the underground side (to the right in FIG. 2) with respect to inner cylinder 8, each latch 9 is projected out of its window 17 by spring 16. An annular recess 19 is provided at the inner surface of pipe 1 (see FIG. 11) for the reception of each latch 9 when convex part 11 of inner cylinder 8 is in contact with stepped part 12 of the drill pipe 1 so that, when latch 9 projects out of its window 17 and fits within recess 19, inner cylinder 8 is locked by end 15 of latch 9 to prevent movement thereof toward the ground surface side with respect to the drill pipe.

Therefore, inner cylinder 8 will be locked by the convex part 11, stepped part 12, latch 9 and recess 19 so as to be immovable either toward the underground side or the ground surface side with respect to drill pipe 1.

Axially extending ribs 20 project into recess 19 so that, when the side surface of each latch 9 contacts them, inner cylinder 8 and drill pipe 1 are prevented from rotating relative to one another. (This shall be described more fully hereinafter.)

A notch 22 is provided at end 15 of each latch for the reception of upper edge 21 of each window 17 when each latch 9 moves into recess 19 so that each latch 9 is prevented from moving away from recess 19 and being pushed into opening 13 of inner cylinder 8 upon engagement between edges 21 and notches 22.

The outer diameter of cylinder 7 at the window 10 location is smaller than the outer diameter adjacent thereto toward the ground surface side, and an annular stepped part 23 interconnects these diameters so that, when upper edge 21 of window 17 fits in notch 22 of latch 9, stepped part 23 contacts annular stepped part 12 formed on the inner surface of drill pipe 1, and the movement of outer cylinder 7 toward the underground side is restricted.

Figure 11:
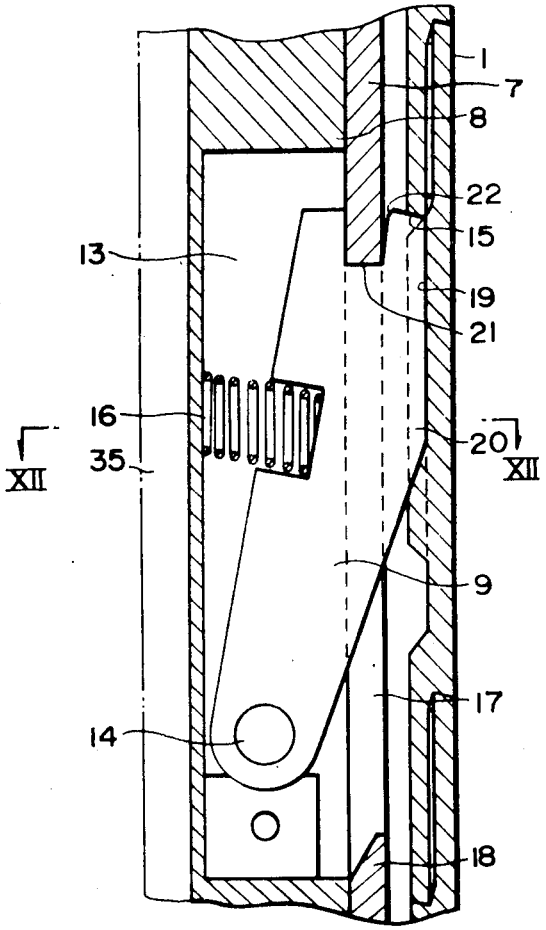
FIG. 11 is a vertically half-sectioned view of an embodiment of the locking mechanism.
Figure 12:
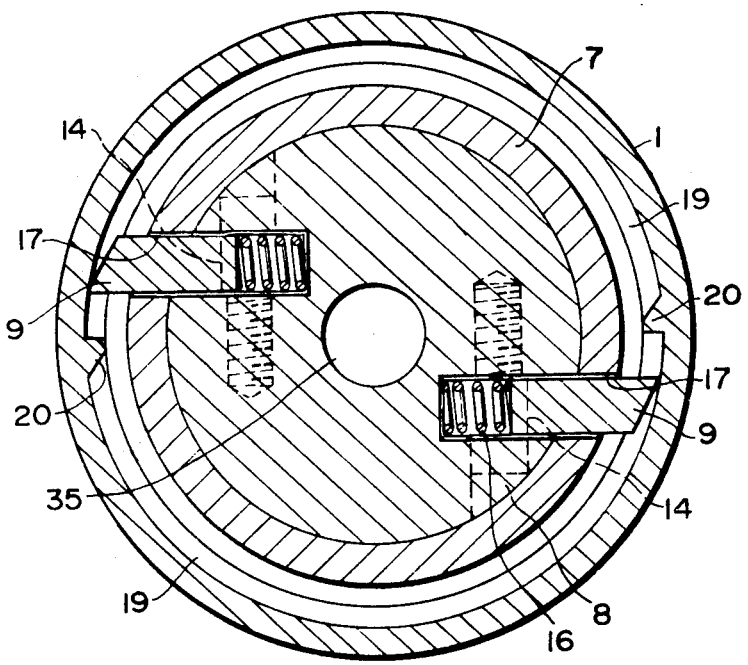
FIG. 12 is a cross-sectional view taken along line XII—XII of FIG. 11.

The details of the mechanism for preventing the relative rotation of drill pipe 1 and inner cylinder 8 are shown in FIGS. 11 and 12. As seen in these drawings, each latch 9 is offset from the center axis of the inner cylinder 8. Therefore, an axial opening 35 serving as a water passage is formed along the center axis of inner cylinder 8. Also the torque produced in drill pipe 1 can be better accommodated with such a latch disposition, and any failure of the setting effected by the engagement of each latch 9 with the inner peripheral surface of the rib 20 will be substantially avoided.

Figure 13B:
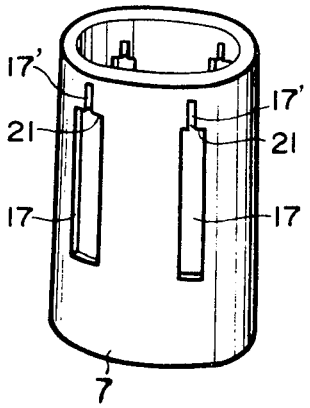

The recess 22 is provided in the form of a notch in the embodiment in FIG. 2, but can also be in the form of a recess at the end surface of latch 9. In such case, a notched groove 17′ (FIG. 13*b*) of a width smaller than the peripheral width of window 17 is provided at its upper edge 21 so that this upper edge 21 may fit in recess 22. Further, as described above, any number of latches can be provided depending on the bore diameter so as to obtain a force sufficient to transmit the torque and thrust. And, by increasing the number of latches, the probability of obtaining a latched condition when desired is improved.

Figure 3:
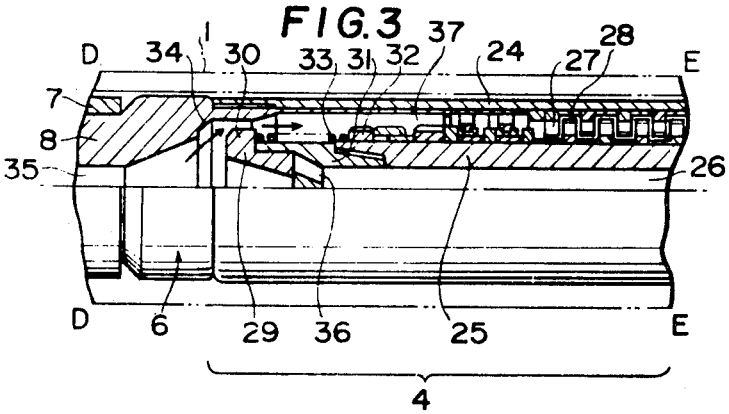

As shown in FIG. 3, the stator (non-rotary part) 24 of the hydraulic motor 4 (shown as a hydraulic turbine in the drawing) is provided as connected at the underground end of the inner cylinder 8, and a rotor (rotary part) 25 is provided concentrically inside the stator. The center of the rotor 25 is hollow for providing a bypass 26 from the inner cylinder to bit 2. 27 is a stator blade on the stator side and 28 is a rotor blade. A cylindrical switching valve 29 is axially mounted for movement in the ground surface side end part of rotor 25. A flange part 30 is formed in the end on the inner cylinder 8 side of switching valve 29. The outer diameter of flange part 30 is larger than the outer diameter of the end part of rotor 25. A spring 33 is located between a fixing member 32 of rotor blade 28 and flange part 30 so as to urge switching valve 29 against an annular valve seat 34 formed on the inner surface of inner cylinder 8. A valve hole 36 leading to bypass 26 from a hollow part 35 of inner cylinder 8 is provided inwardly of end part 31 of rotor 25. When bits 2 and the reaming bits are rotated by hydraulic motor 4 to cut a ground layer, this switching valve 29 will direct water under pressure from the ground surface side end part of drill pipe 1 to bit 2 through inner cylinder 8. This water pressure is considerably higher than the water pressure exiting from bit 2 through inner cylinder 8 when cutting part 6 is to be pulled up toward the ground surface side. Therefore, this switching valve 29 will act the same as a generally used safety valve, spring 33 will be compressed by the high pressure water fed for drilling to separate switching valve 29 from valve seat 34. Hollow part 35 of inner cylinder 8 will then be connected with a water passage 37 for generating a torque between stator blade 27 and rotor blade 28, and switching valve 29 will be pressed against valve hole 36 to close it so that water will be prevented from passing to bypass 26 from hollow part 35 of inner cylinder 8.

The fed water pressure jetting out of bits 2 through inner cylinder 8 when cutting part 6 is to be pulled up toward the ground surface side will be regulated to be considerably lower than the water pressure fed at the time of drilling. Therefore, at the time of pulling up cutting part 6, flange part 30 of switching valve 29 will be pressed against valve seat 34 to prevent water from flowing to water passage 37 from hollow part 35 so that rotor 25 will not rotate. The switching valve 29 will open valve hole 36 so as to pass water to bits 2 through bypass 26 from hollow part 35.

Figure 4:
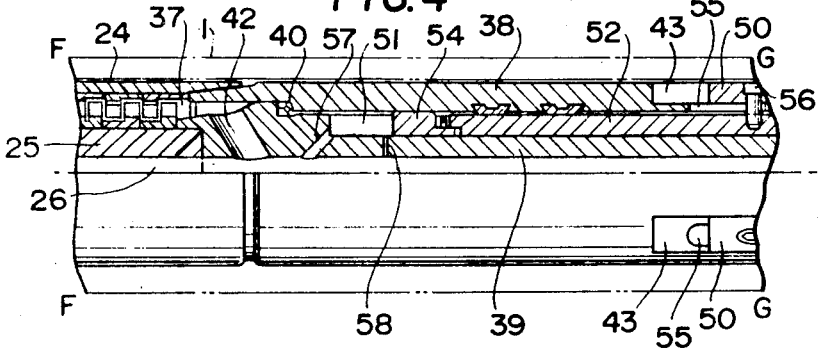
Figure 5:
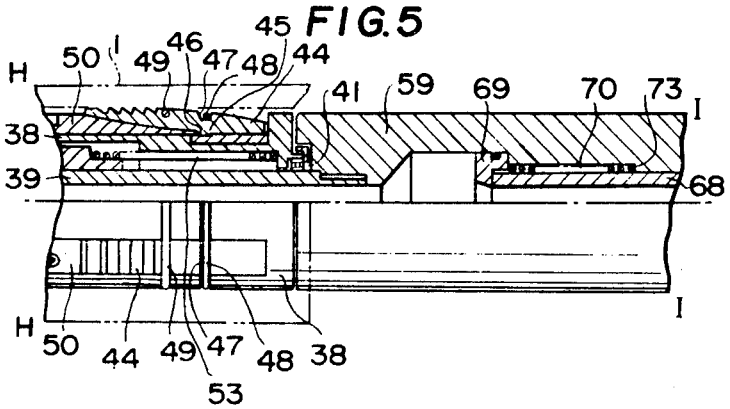

As shown in FIGS. 4 and 5, the underground side extension 38 of stator 24 of hydraulic motor 4 is extended to the underground side end of drill pipe 1. The underground side extension 39 of rotor 25 is extended into the underground side extension 38 of stator 24. The rotor 25 is concentrically mounted for rotation relative to stator 24 by means of bearings 40 and 41 provided between both ends of the underground side extension 39 of rotor 25 and the underground side extension 38 of stator 24. On the rotor 25 side from bearing 40 of extension 39, a through hole 42 is provided to lead water from the water passage 37 for generating a torque into the extension 39.

Axially extending grooves 43 are spaced on the outer peripheral surface on the underground side of extension 38. A rectangular pressing piece 44 is located in each groove 43, and has a semicircular rib 45 extending in the direction at right angles with respect to the center line of the cutting part, and is fitted in a shallow arcuate concave groove 46 formed at the bottom of the groove 43 so as to be pivotable on ribs 45. Each piece 44 is held within its groove 43 by an annular spring 48 located in a concave groove 47 provided, as opposed to rib 45, on the surface on the opposite side of rib 45 and surrounding extension 38. Further, in a position nearer to the ground surface than annular spring 48, an annular spring 49 is provided for a purpose similar to annular spring 48 which is to press the side of piece 44 nearer the ground surface than the rib 45 toward the bottom of groove 43. A wedge 50 is disposed for axial movement in groove 43 on the ground surface side between the bottom of groove 43 and pressing piece 44. A sliding piece 52 is disposed for movement in an axially extending groove 51 provided on the outer surface of extension 39. A spring 53 is located between the underground side end of sliding piece 52 and the end wall of groove 51 so as to push the sliding piece 52 toward the ground surface side. At the ground surface side end of sliding piece 52, a piston 54 is disposed in contact with the bottom of groove 51 and the inner surface of extension 38. A window 55 communicating inwardly and outwardly is provided in the ground surface side bottom of groove 43. The wedge 50 and sliding piece 52 are interconnected by means of a screw 56 passing through window 55. A small hole 57 leading to the interior of extension 39 extends diagonally toward the ground surface side from the ground surface side end of groove 51.

The water under high pressure (for example, of about 20 kg/cm$^2$) having rotated the hydraulic motor at the time of cutting will enter extension 39 on the underground side from the hole 42 and a portion thereof will enter a chamber formed by groove 51 and the inner surface of extension 38 through small hole 57. The pressurized water will then push piston 54 toward the underground side and will move sliding piece 52 toward the underground side against spring 53. Then, wedge 50 which is connected with sliding piece 52 will be pushed in between pressing piece 44 and groove 51 so as to move pressing piece 44 on the ground surface side outwardly against annular spring 49, and thereby press it against the inner surface of drill pipe 1.

When pressing piece 44 is thus pressed against the inner surface of drill pipe 1, extension 38 will be fixed concentrically with drill pipe 1 therewithin so as to maintain the drilling direction of bit 2 along the center line.

The pressure of the water fed through bypass 26, when cutting part 6 is pulled up toward the ground surface through drill pipe 1, is so considerably lower than at the time of cutting that spring 53 will push back piston 54 toward the ground surface side against this water pressure. Wedge 50 will move toward the ground surface side and annular spring 49 will separate pressing piece 44 from the inner surface of drill pipe 1, and will pull in the outer surface of pressing piece 44 so as to be flush with the open surface of groove 43. 58 is an orifice connecting the inner surface of extension 39 with groove 51 and is provided nearer the underground side than small hole 57 and nearer the ground surface side than piston 54 when positioned nearest the ground surface side.

In the above embodiment, longitudinal grooves can be located at the outer periphery of extension 39 and a bar can be used instead of sliding piece 52. Further, pressing piece 44 can be provided in the form of a hinge on extension 38 by means of a pin provided on the side surfaces of groove 43. Also, a cam groove can be provided on both side surfaces of pressing piece 44 instead of using wedge 50, and a pin provided on the above mentioned bar can be inserted in the cam groove so as to open and close pressing piece 44. Further, it is possible to operate pressing piece 44 by connecting the above mentioned bar with outer cylinder 7 in FIG. 2 instead of using piston 54 and spring 53.

According to the above mentioned structure, the bits and reaming bits can be fixed to drill pipe 1 so as to produce no swinging in the locking positions, and the digging direction can be controlled for any desired direction.

At the underground side end of extension 39, a bit holder 59 is connected and projects toward the underground side from the end of drill pipe 1. This bit holder 59 is in the form of a cylinder open at both ends and fitted with roller type bits 2 on the underground side. A bit body 60 for bits 2, in the form of a plug, is threaded into the end part of bit holder 59 and is provided with jetting orifices 61 at its center so that water may be jetted toward bits 2 from bit holder 59.

The bit holder 59 is provided with three to four windows 62 at a spacing on the peripheral surface thereof on the ground surface side from bits 2.

Each window 62 is so dimensioned that roller type reaming bits 3 and bit bodies 63 supporting them may just fit therewithin. Bit body 63 is mounted at one end about pin 64 for pivotal movement into and out of window 62 on the reaming bit 3 side. 65 is a groove located on the side surface of bit body 63. A stopper 66 provided on the side surface of window 62 is located in groove 65 so as to regulate the degree of outward projection of reaming bit 3. 67 is a spring located in an annular groove provided at the inner surface on the ground surface side of window 62 near pin 64 so as to push the end surface of bit body 63 for moving reaming bit 3 always within window 62.

Figure 6:
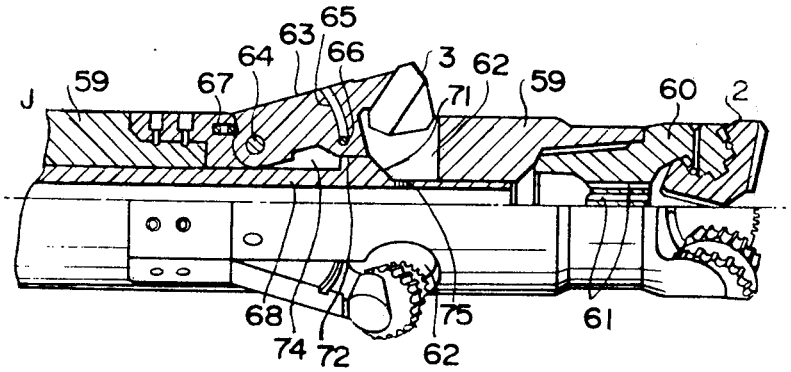
Figure 7:
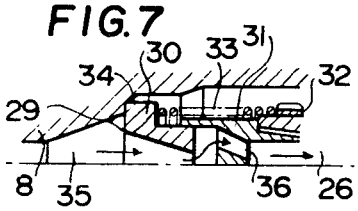
FIG. 7 is a partial view of FIG. 3 showing the operation of a switching valve.

An operating tube 68 operating to open and close reaming bits 3 is provided for axial movement in contact with the inner surface of bit holder 59. The operating tube 68 opens at the underground side end toward the inner surface of bit body 60 and opens at the ground surface side end toward the hollow part of extension 39. An annular piston 69 is located at the ground surface side end of operating tube 68 so as to be in contact with the inner surface of bit holder 59. A convex part 72 having a slope 71 inclined toward the underground side is formed on the outer surface of operating tube 68 facing windows 62 so that, when piston 69 is pushed toward the underground side by the water pressure at the time of digging and operating tube 68 moves toward the underground side, as shown in FIG. 6, the inner surfaces of bit bodies 63 are pushed by convex part 72, and reaming bits 3 are expanded outwardly of the outer peripheral surface of drill pipe 1 through windows 62. In this structure, when reaming bits 3 are advanced toward the underground side, the thrust will act on reaming bits 3 to further expand them. Therefore, it is desirable to maintain such structure as can adequately resist it and will not expand then more than is necessary. A spring 70 for pushing piston 69 toward the ground surface side is located between piston 69 and a stepped part 73 provided at the inner surface of bit holder 59 on the outer periphery on the ground surface side of operating tube 68 so as to allow piston 69 to move toward the underground side against the pressure of water applied within bit holder 59 at the time of digging, but to push back piston 69 toward the ground surface side against this water pressure fed toward bit 2 through bit holder 59 when cutting part 6 is pulled up toward the ground surface side. Operating tube 68 is therefore moved toward the ground surface side thereby allowing convex part 72 to move to a recess 74 on the inner surface of bit body 63 and allowing reaming bit 3 to return back into window 62. An orifice 75 is provided in a portion of operating tube 68 facing reaming bit 3 so that water may be fed to reaming bit 3 through the windows 62 from within operating tube 68.

The water passage is formed as described above within cutting part 6. The water passage closing mechanism 88 for interrupting the entry of water into this water passage is arranged as follows.

The ground surface side of outer cylinder 7 extends farther toward the ground surface side than upper end 76 of inner cylinder 8, and an inwardly bent shoulder 77 is formed at the end of outer cylinder 7. A cylindrical spearhead 78 (shown in detail in FIG. 14 and more fully described hereinafter) is disposed for axial movement within the extension of outer cylinder 7, and partially projects outwardly of outer cylinder 7. The lower end 79 of spearhead 78 within outer cylinder 7 is in contact with upper end 76 of inner cylinder 8.

Figure 1:
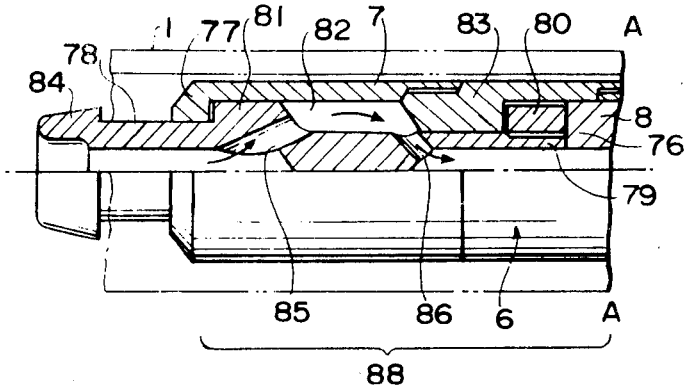

The degree of the projection of spearhead 78 outwardly of outer cylinder 7 is regulated by an annular convex part 81 located behind shoulder part 77 of outer cylinder 7. A space 82 is formed between outer cylinder 7 and spearhead 78, and between a ring 80 secured to the outer periphery of lower end 79 and annular convex part 81. An annular valve 83 sliding in contact with the outer periphery of spearhead 78 is formed integrally with outer cylinder 7 within space 82 at the inner surface of outer cylinder 7. The spearhead 78 is hollow from upper end 84 to the interior of annular convex part 81. A passage 85 leads to space 82 from the interior of annular convex part 81. Further, spearhead 78 is hollow at lower end 79 so as to communicate with hollow part 35 of inner cylinder 8. A valve hole 86 communicating with space 82 is formed as somewhat separated from passage 85. The portion between passage 85 and valve hole 86 of the spearhead 78 is made solid. As shown in FIG. 1, an annular valve 83 of outer cylinder 7 is so provided as to be located nearer the underground side than valve hole 86 of spearhead 78 when lower end 79 of spearhead 78 is in contact with upper end 76 of inner cylinder 8, as shown in FIG. 1, and upper edge 21 of window 17 of outer cylinder 7 is fitted within notch 22 of latch 9, as shown in FIG. 2.

Therefore, when cutting part 6 is locked by drill pipe 1, the pressurized water fed into drill pipe 1 from the ground surface side end thereof will enter spearhead 78 from upper end 84 thereof, will proceed through passage 85, space 82 and valve hole 86 and will flow into inner cylinder 8 (see arrows of FIG. 1). The pressurized water will reach hydraulic motor 4 through locking mechanism 5 from inner cylinder 8, will push down switching valve 29 to close valve hole 36, will pass through water passage 37 (see arrows of FIG. 3) for generating a torque of hydraulic motor 4, and will thus rotate rotor 25 of hydraulic motor 4 to rotate reaming bits 3 and bits 2. Some portion of the pressurized water coming out of hydraulic motor 4 will push down piston 54 to open out reaming bits 3, and another greater portion of the pressurized water will pass through bit holder 59 to be jetted onto reaming bits 3 through the orifices 75 and onto bits 2 through jetting orifices 61. The water fed to bits 2 and reaming bits 3 and carrying the powder cut by them will be discharged out on the ground surface through the outside of drill pipe 1. The ground can be drilled by only advancing the drill pipe 1 into the ground without rotating it.

The system for pulling up cutting part 6 to the ground surface through drill pipe 1 while leaving drill pipe 1 in the ground after unlocking cutting part 6 and drill pipe 1 is as follows.

Before describing this pulling-up operation, spearhead 78 shown in FIG. 14 shall be first described.

As shown therein, several conical through openings 91 are spaced along the periphery in end part 90. The small diameter side of conical openings 91 is on the hollow part side and a steel ball 92 of such diameter as can slightly project out of the small diameter side is located therein. The thickness of the peripheral wall of this end part 90 is smaller than the diameter of steel balls 92 so that, when the balls project outwardly of holes 91 at the hollow part side, they will not project outwardly of the outer peripheral surface of end part 90. A sleeve 93 having a conical outer surface is mounted for axial movement on the outer periphery of end part 90. A spring 96 is disposed between a stepped part 94 provided at the outer surface of spearhead 78 and a stepped part 95 provided at the inner surface of sleeve 93 so as to push sleeve 93 outwardly of end part 90. Inner surface 97 of sleeve 93 located at the end surface side of end part 90 is of a large diameter so that steel balls 92 are at least flush with the inner surface of end part 90 and may project outwardly of the outer peripheral surface of end part 90. Further, the inner surface of sleeve 93 between inner surface 97 and stepped part 95 is of such an inner diameter as to press steel balls 92 to project them into the hollow part of end part 90 as shown in the drawing. 98 is a stopper ring secured about the outer periphery of end part 90 to prevent the part between the inner surface 97 of sleeve 93 and stepped part 95 from being projected by spring 96 beyond the position corresponding to conical openings 91.

A pulling-up wire 100 for pulling cutting part 6 locked within drill pipe 1 up to the ground surface comprises a flexible tube formed of a rubber tube 102 located within a layer 101 of cylindrical twisted wires as shown in FIG. 15, or formed of a spirally wound metal strip. A connecting tube 104 is connected at one end by means of a nut 103 with wire 100.

As shown in FIG. 16, a part having such diameter and length as can be inserted toward stepped part 99 formed within end part 90 of spearhead 78 in FIG. 14, is formed at the other end 105 of connecting tube 104. An annular groove 106 is formed on the outer periphery of connecting tube 104 corresponding to conical openings, groove 106 accommodating balls 92 when other end 105 is inserted toward stepped part 99.

The outer diameter of a middle part 107 of connecting tube 106 is larger than its ends. Guides 108 in the form of a pair of tubes are mounted on the outer surface of middle part 107 in opposite relation to one another. The outer diameter of each guide 108 is slightly smaller than the inner diameter of drill pipe 1. The connecting tube 104 is maintained in concentric relation to drill pipe 1 and is moved therewithin. A plurality of axial grooves 109 are spaced on the outer surface of guide 108 so that, when guides 108 are advanced within the drill pipe, water may pass through such grooves 109.

Bar-shaped hooks 111 each having an L-shaped hook 110 at one end are disposed between guides 108 with hooks 110 opposed to each other (see also FIG. 17). A semicircular convex part 112 is formed at the other end of each hook 111 and is fitted in a shallow arcuate concave part 113 provided on the outer peripheral surface of part 107. The two guides 108 are interconnected by means of pins 114 inserted from the side surfaces of grooves 109 into the centers of the semicircles of convex parts 112, whereby end 110 of each hook is pivotable about the pin. Each hook 111 is extended at its end 110 beyond other end 105 of connecting tube 104 so that, when connecting tube 104 is inserted at its other end 105 toward stepped part 99 of spearhead 78, end 110 of each hook 111 can grasp sleeve 93 on the underground surface side thereof. A spring 116 is disposed between end 115 of each hook 111 and connecting tube 104 so as to push the hooks at their ends 110 toward one another. By reason of the pin 114 connection between hooks 111 and guides 108, the hooks are prevented from moving axially with respect to the connecting tube.

As shown in FIG. 18, the wire 100 is wound about a winder 117 and is connected with a pump 118 at the center axis of winder 117. The wire 100 fitted with an overshot 119 and hooks 111, seen more clearly in FIG. 15, is inserted at one end into drill pipe 1 from the ground surface side and water under pressure is fed into drill pipe 1 to feed overshot 119 toward cutting part 6.

As shown in FIG. 19, overshot 119 having reached cutting part 6 will push sleeve 93 of spearhead 78 with end 110 of each hook 111 against the spring 96 so that steel balls 92 will project outwardly of the conical openings 91 toward inner surface 97 of sleeve 93. When hooks 111 slide on the surface of sleeve 93 while pushing same, connecting tube 104 will enter end part 90 of spearhead 78 at its end 105 and, when it is seated within stepped part 99, ends 110 of the hooks will be fully spread so that spring 96 will push back sleeve 93 against the frictional force between the end surface of ends 110 and sleeve 93. Steel balls 92 will then be fitted into groove 106 of connecting tube 104, and hooks 110 will embrace sleeve 93 so that connecting tube 104 may be securely connected to spearhead 78 (see FIG. 20).

Then, wire 100 is wound up by means of wire feeding apparatus 120 and 121 wherein two sets of conveyor belts are arranged adjacent one another, as are shown in FIG. 18, and is wound by means of winder 117.

Figure 8:
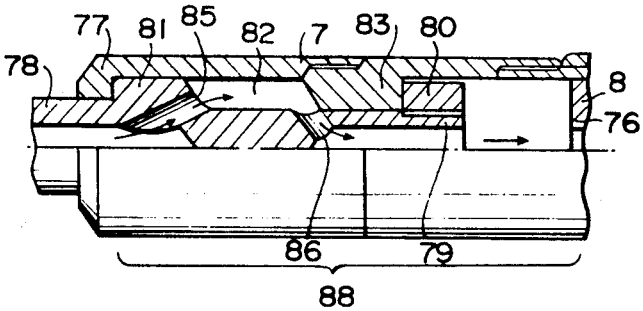
FIG. 8 is similar to FIG. 1 and further showing the condition of a water passage closing mechanism portion when the cutting portion is pulled up.

When cutting part 6 is pulled upwardly by means of wire 100, spearhead 78 will be pulled toward the ground surface side and will therefore pull outer cylinder 7 toward the ground surface side as is. Then, outer cylinder 7 will move toward the ground surface side with respect to inner cylinder 8, so that upper edge 21 of window 17 of outer cylinder 7 will separate from the notch 22 of latch 9 and will rise and further, by the movement of outer cylinder 7 toward the ground surface side, lower edge 18 of window 17 will push latch 9 on the side surface of separate it from recess 19 of drill pipe 1 and push it into recess 13 of inner cylinder 8 and will thus unlock cutting part 6 and drill pipe 1. Therefore, cutting part 6 can be pulled up toward the ground surface from the lower end of drill pipe 1. At this time, the relative positions of outer cylinder 7 and spearhead 78 will be the same as in FIG. 1, and outer cylinder 7 will have moved toward the ground surface side with respect to inner cylinder 8 as shown in FIG. 8.

If it becomes necessary to feed 1500 liters of water per minute into drill pipe 1 when drilling through depending on the size of the system, if about 200 liters of water per minute are fed into inner cylinder 8 through the hollow wire at the time of pulling up the cutting part 6, the water pressure applied to switching valve 29 and pistons 54 and 69 will be so considerably lower than at the time of digging that switching valve 29 will be pressed against the valve seat 34 by spring 33 to cause the water from hollow part 35 of inner cylinder 8 to flow to bit holder 59 through bypass 26 and therefore rotor 25 of the hydraulic motor will remain stopped. Further, piston 54 will be moved toward the ground surface side by spring 53 to separate pressing piece 44 from the inner surface of drill pipe 1, piston 69 will be moved toward the ground surface side by spring 70 and reaming bits 3 will re-enter their windows 62 by means of springs 67 to render drill pipe 1 passable. As the cutting part can be thus pulled up while discharging water out of jetting orifices 61 of bit body 60, no vacuum will be produced around bits 2 within drill pipe 1 and the drilled bore in the ground layer, therefore the bore wall will not collapse and the extent of the pulling-up force will be less than heretofore required.

As can be seen from the above, according to the method of the present invention, the velocity of pulling up the cutting part 2 from the underground side end of drill pipe 1 can be higher than before and the force required for wind-up can be reduced.

The hollow wire 100 can be connected at one end directly with cutting part 6 so that the water required during drilling may be fed therethrough. However, a large amount of water must be fed around the bits as mentioned above during drilling. However, the cross-sectional area of the wire is so much smaller than that of the drill pipe that, in order to feed the same amount of water through the wire, the water passing resistance will be higher than in the case of feeding water through the drill pipe, so that the applied pressure will have to be made higher and therefore a high pressure pump and greater power cost will be required. Further, when the wire is hung on the drill pipe even during drilling, not only will the wire weaken from fatigue by its own weight thereby shortening the life of the wire but it will also be necessary to pay out the wire at the speed at which the drill pipe is lowered into the ground. When drilling by rotating the drill pipe, the friction between the inner surface of the drill pipe and the wire will need to be contended with. However, when the wire is made removable from the cutting part so as to be used only to pull up the cutting part as in the present system, the operation will be made easier and the power cost and equipment cost may be reduced.

The cutting part 6 is fed toward the underground side from the ground surface side end of drill pipe 1 and is locked at the underground side end as follows.

Figure 9:
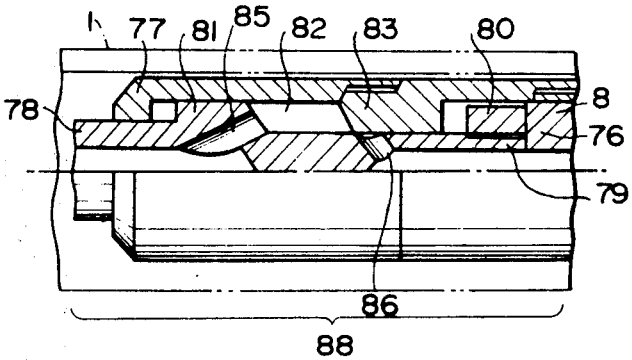
FIG. 9 is similar to FIG. 1 and further showing the condition of the water passage closing mechanism part when the cutting part is fed to the underground side through the drill pipe.
Figure 10:
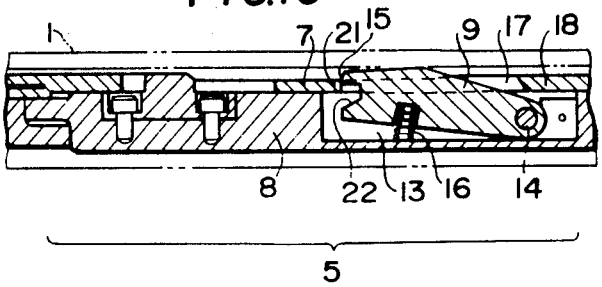
FIG. 10 is similar to FIG. 2 and further showing a locking mechanism when the water passage closing mechanism part is in the condition shown in FIG. 9.

As shown in FIG. 8 outer cylinder 7 is pulled toward the ground surface side with respect to inner cylinder 8 and is inserted into drill pipe 1 while latch 9 is closed. Then 750 liters of water per minute are fed, for example, into drill pipe 1 from the ground surface side end and cutting part 6 is fed toward the underground side through drill pipe 1 at this water pressure. A rubber ring 89 having an outer diameter substantially in contact with the inner surface of drill pipe 1 is fitted to the outer periphery of the outer cylinder 7 as shown in FIG. 2. The pressure of the water fed into the drill pipe will be first applied to this rubber ring 89 and shoulder part 77 of outer cylinder 7 so as to move outer dylinder 7 toward the underground side relative to inner cylinder 8. Therefore, lower edge 18 of window 17 which had pressed latch 9 inwardly, will move toward the underground side, and latch 9 will be projected out of window 17 so as to be half opened as shown in FIG. 10 and into contact with the inner surface of drill pipe 1, and will be moved while contacting the inner surface of drill pipe 1. Further, outer cylinder 7 will move toward the underground side but, as latch 9 is half opened, upper edge 21 of window 17 will not be able to fit into notch 22 of latch 9, and outer cylinder 7 will be prevented from moving toward the underground side relative to cylinder 8. On the other hand, since the portion between passage 85 and valve hole 86 is solid, the water pressure will be applied also to this portion to bring spearhead 78 into contact with inner cylinder 8 as shown in FIG. 9. However, as outer cylinder 7 is located on the ground surface side with respect to inner cylinder 8 by the depth of notch 22 of latch 9, annular valve 83 provided inwardly of outer cylinder 7 will close valve hole 86 of spearhead 78 as shown in FIG. 9.

Therefore, when cutting part 6 is to be fed toward the underground side with the water fed into drill pipe 1, water passage closing mechanism 88 will act to prevent the water from passing through cutting part 6. Cutting part 6 will therefore be able to be efficiently fed in and, at the same time, a torque will be generated by hydraulic motor 4 to expand reaming bits 3 with a centrifugal force, and the inner surface of drill pipe 1 will avoid damage.

In the above described embodiment, water passage closing mechanism 88 includes mostly spearhead 78 and outer cylinder 7. However, it can further include the outer cylinder 7 and inner cylinder 8, or can be operated by the coincidence or noncoincidence of holes made in both of them. Further, switching valve 29 can be also formed so as to be operated with the outer cylinder without using spring 33. The reaming bit 3 opening and closing mechanism can be also modified. Any well known reaming bits can be also used. The hydraulic motor 4 may be of a turbine type, snake pump type or any other type. The rotor can be outside and the stator can be inside. The bit 2 to be used may be a bit for cutting off cores.

According to the drilling system of the present invention described above, the hydraulic motor having and directly connected with the reaming bits and bits can be fed to the lower end of the drill pipe and can be pulled up through the drill pipe while leaving the rotation of the hydraulic motor stopped, the flow of water into the cutting part can be properly made and the drilling work can be carried out efficiently.

The embodiment shown in FIGS. 21 and 22 will now be described.

In this embodiment, as different from the embodiment shown in FIGS. 1 to 10, the digging force is transmitted to the drill pipe from the ground surface as in the conventional example and other differences in the structure from the above mentioned embodiment can be seen, but its basic idea is the same as in the above mentioned embodiment and it is needless to say that the features of this embodiment can be added to the embodiment in FIGS. 1 to 10.

Now, in FIGS. 21 and 22, the same parts as in the embodiment in FIGS. 1 to 10 are represented by the same corresponding reference numerals.

1 is a drill pipe and, the same as in the conventional drilling system, depending on the depth of the bore to be drilled, as many interconnected drill pipes 1 are used as is necessary. As explained in the following, this drill pipe 1 is to effect mostly a torque and thrust into the ground to the bits 5 locked to the underground side lower end.

The bit 5 is so designed as to be fitted to the lower end 122 of inner cylinder 8. The outer cylinder 7 is arranged on the outer periphery of inner cylinder 8 so as to be axially movable relative thereto. The outer cylinder 7 and bit 5 are of such diameters as can be inserted into drill pipe 1.

Concave grooves 123 extending in an axial direction are provided on the outer surface near lower end 122 of inner cylinder 8. A reaming bit 3′ of such width and length as can be fitted in concave groove 123 is pivoted on a pin 64′ at the lower end 122 side within concave groove 123, as different from the above mentioned embodiment shown in FIGS. 1 to 10, so as to be movable into and out of concave groove 123 using pin 64′ as a fulcrum. This reaming bit 3′ is provided with a diamond grain projecting in the same manner as bit 5 on the outer surface so as to cut the earth and sand.

The latch 9 is pivoted at one end about pin 14 and extends axially at its other end toward upper end 76 of inner cylinder 8 so as to project at this other end out of window 17 located in outer cylinder 7 by means of spring 16 located between this other end and inner cylinder 8.

Further, on the upper end 76 side of latch 9, convex part 11 which is fixed to inner cylinder 8 and which projects out of inner cylinder 8, projects out of window 10 located in outer cylinder 7. The window 10 has such an axial length as to allow convex part 11 to move axially therewithin so as to permit the necessary relative axial movement of inner cylinder 8 and outer cylinder 7.

The outer cylinder 7 extends at its lower end 124 to the concave groove 123 of inner cylinder 8, a cut portion 125 being formed in an axial direction from said end and the reaming bit 3′ being fitted in cut portion 125. An inwardly projecting pin 126 is provided near the end part of the inner surface opposed to cut portion 125 and is located in a groove 127 formed on each side surface of reaming bit 3′. The groove 127 extends in the form of S in the lengthwise direction on the side surface of reaming bit 3′, so that, when outer cylinder 7 is moved in an axial direction relative to inner cylinder 8, reaming bit 3′ may be pivoted about pin 64′, it may be contained in concave groove 23 and may be projected out of drill pipe 1 from concave groove 123.

An annular convex part 128 is provided on the inner surface of drill pipe 1 so that convex part 11 of inner cylinder 8 may come into contact with it. When convex part 11 collides with annular convex part 128, in inner cylinder 8, reaming bits 3′ and bits 5 may project out of lower end 129 of the drill pipe 1 but the other parts may be retained within the drill pipe 1.

The recess 19 is formed on the inner surface of drill pipe 1 so as to be opposed to latch 9. When outer cylinder 7 is moved relative to inner cylinder 8 so as to project reaming bits 3′ outwardly of drill pipe 1, latch 9 will project outwardly of window 17 and will fit into recess 19 of drill pipe 1.

Therefore, inner cylinder 8 can be locked so as not to move toward either the underground side of the ground surface side by means of recess 19 and annular convex part 128 of drill pipe 1 and reaming bits 3′ and convex part 11 of inner cylinder 8 while reaming bits 3′ and bits 5 are projected outwardly of lower end 129 of drill pipe 1. The thrust applied to drill pipe 1 from the ground surface toward the underground side by this mechanism will be transmitted to bit 5 and reaming bit 3′.

The rib 20 extending in an axial direction is provided in recess 19 of drill pipe 1 so that, when the side surface of latch 9 contacts wall 22, the torque applied to drill pipe 1 may be transmitted to inner cylinder 8, and bits 5 and reaming bits 3′ may be rotated together with drill pipe 1 (as detailed in the above).

Likewise similar to the earlier described embodiment, latch 9 is provided with notch 23.

In order to transmit the rotation of drill pipe 1 to inner cylinder 8, any other part, for example, convex part 11 may be used. Further, in the structure provided for opening and closing reaming bits 2′ at lower end 124 of outer cylinder 7, inner cylinder 8 side surface of reaming bit 3′ may be engaged with lower end 124 of outer cylinder 7.

When outer cylinder 7 is moved toward the upper end 76 side with respect to inner cylinder 8, reaming bit 3′ will move inwardly from the inner surface of drill pipe 1 and will be able to pass through drill pipe 1 but, when outer cylinder 7 is moved upwardly with respect to inner cylinder 8 so as to close reaming bit 3′, upper edge 21 of window 17 will simultaneously separate from notch 22 of latch 9 and outer cylinder 7 will rise. When reaming bit 3′ is moved inwardly from the inner surface of drill pipe 1 and the outer cylinder 7 further rises, lower edge 18 of window 17 will push the latch 9 on its outer surface to pivot in inwardly and latch 9 will separate from recess 19 of drill pipe 1 so that inner cylinder 8 may be movable toward the ground surface side with respect to drill pipe 1.

If a large cutting resistance in the direction of closing the reaming bits acts on the cutting surface of reaming bit 3′ during digging, this resistance will become a force to push up outer cylinder 7 toward the ground surface side and will push outer cylinder 7 toward the ground surface side relative to inner cylinder 8. When outer cylinder 7 thus rises, latch 9 will separate from recess 19 of drill pipe 1 as described above and inner cylinder 8 will entirely enter drill pipe 1 so that no more cutting may be made. The mechanism for preventing it shall be described as follows.

A recess 130 is provided at upper end 76 of inner cylinder 8. An internal latch 131 is mounted for pivotal movement at one end about a pin 132 within this recess 130 and is made to project outwardly at its other end side 133 of recess 130 by means of a spring 134. A sliding tube 135 is provided between inner cylinder 8 and outer cylinder 7 so as to be movable axially on the surface. Side 133 of internal latch 131 can project outwardly of a window 136 located in sliding tube 135. The outer cylinder 7 is provided with a recess 137 which will engage with internal latch 131 at its side 133, as shown in the drawing, when outer cylinder 7 projects reaming bits 3′ out of drill pipe 1 so that latch 9 may fit in recess 19 of drill pipe 1. When the projected side 133 fits in recess 137, outer cylinder 7 will be prevented from rising relative to inner cylinder 8 from the position in which reaming bit 3′ and latch 9 are expanded.

In this embodiment, outer cylinder 7 is farther extended in the shoulder part 77′ than upper end 76 of inner cylinder 8 and is closed, a pulling-up spearhead 78′ is located for axial movement at the center of outer cylinder 7, and a sliding tube 135 is connected with a part 138 secured integrally with pulling-up spearhead 78′ within outer cylinder 7. The length by which spearhead 78′ comes out of or into outer cylinder 7 is regulated by a flange part 139 in contact with shoulder part 77′ of outer cylinder 7 and a part 138 is fitted therewithin. A spring 140 pulling spearhead 78′ toward the inner cylinder 8 side is provided between the inside of shoulder part 77′ and flange part 139.

When this spring 140 is compressed to pull spearhead 78′ out of outer cylinder 7, sliding tube 135 will be moved toward shoulder part 77′ of outer cylinder 7 between inner cylinder 8 and outer cylinder 7 so that internal latch 131 may be separated at its other end side 133 from recess 137 of outer cylinder 7 by lower side edge 141 of window 136, and may be pushed into recess 130 of inner cylinder 8.

As seen from the above description, the drawing shows inner cylinder 8 as locked to the underground side end part of the drill pipe 1 so as to be ready for drilling. When drill pipe 1 is rotated on the ground while applying a pressure toward the underground, a bore will be drilled by means of the bits 5, and reaming bits 3′ will expand the bore drilled by bits 5 so that drill pipe 1 may be advanced. At this time, water to which a pressure is applied is fed from the ground surface into drill pipe 1 and into hollow part 35 of inner cylinder 8 through holes 142 located in the shoulder part 77′ of outer cylinder 7, and is jetted out of water orifices 143 of bits 5 to cool the bits and then cool the reaming bits, and the cut powder made by this operation is discharged on the ground surface through the outside of drill pipe 1. The bit 5 may be a core cutting bit for cutting off a geological sample in a cylindrical form, and a core receiving tube may be fitted within inner cylinder 8.

The bits 5 will be worn during the progress of the drilling. Therefore, when the velocity of the advance of drill pipe 1 into the ground has reduced so much as to make it necessary to replace bits 5, or when a ground layer of a length which can be contained in the core receiving tube has been cut off, a pulling-up tool fitted with a wire is lowered into drill pipe 1 from the ground surface and is connected with spearhead 78′.

When the wire is pulled on the ground surface to pull up spearhead 78′ toward the ground surface, sliding tube 135 connected with spearhead 78′ will move to the shoulder part 77′ side of outer cylinder 7, and lower side edge 141 of window 135 will disengage internal latch 131 on the other end side 133 from recess 137 of outer cylinder 7. When outer cylinder 7 is then pulled toward the ground surface side so as to rise relative to inner cylinder 8, reaming bits 3′ will move inwardly of the inner surface of drill pipe 1, and then latch 9 will be disengaged from recess 19 of drill pipe 1 by lower edge 18. Therefore, if the wire is further pulled up toward the ground surface, inner cylinder 8 having bits 5 and reaming bits 3' through outer cylinder 7 from spearhead 78' and through convex part 11 inserted in window 10 of outer cylinder 7, will be able to be pulled up to the ground surface while leaving drill pipe 1 in the underground.

When bits 5 have been replaced and the geological sample (core) cut off in the underground has been taken out of the core receiving tube, the cutting part consisting of the inner cylinder 8, outer cylinder 7 and others is fed into the underground as follows.

In the free state, spearhead 78' is located adjacent to the upper end 76 side of inner cylinder 8 and internal latch 131 can be projected at its side 133 out of window 136 of sliding tube 135. If reaming bits 3' and latches 9 project out of outer cylinder 7 on the ground as shown in the drawing, internal latch 131 will also fit in recess 137 of outer cylinder 7. Therefore, when spearhead 78' is pulled toward the side on which it comes out of outer cylinder 7, internal latch 131 is disengaged from recess 137, bits 5 are gripped and inner cylinder 8 is pulled toward bits 5 out of outer cylinder 7, reaming bits 3' and latches 9 will close so that the cutting part may be inserted through drill pipe 1. If spearhead 78' is separated, it will partly return into outer cylinder 7 due to spring 140 and, as inner cylinder 8 has been moved to lower end 124 side of outer cylinder 7 with respect to outer cylinder 7, internal latch 131 will project out of window 136 of sliding tube 135 to be in contact with the inside surface on the lower end 124 side than recess 137 of outer cylinder 7.

In this condition, the cutting part is fed in toward the lower end of drill pipe 1 by using pressurized water or the like. When it reaches the underground side end part of drill pipe 1, convex part 11 of inner cylinder 8 will contact annular convex part 128 at the inner surface of the drill pipe 1, and bits 5 and reaming bits 3' will project beyond the underground side end part 129 of drill pipe 1. Then the pressurized water fed into drill pipe 1 from the ground surface will push down outer cylinder 7 like a piston, will first open reaming bits 3', will then fit latch 9 in recess 19 of drill pipe 1, will fit internal latch 131 in recess 137 of outer cylinder 7 and will lock cutting part in the underground side end part of drill pipe 1 so as to be able to drill the ground.

It should be noted that in the drawing, 144 is a rubber ring fitted as in the manner of a piston ring on the outer periphery of outer cylinder 7, and is provided to feed the cutting part toward the underground side end of drill pipe 1 with pressurized water, and to prevent the pressurized water from flowing out of drill pipe 1 through between outer cylinder 7 and drill pipe 1.

In the above embodiment, internal latch 131 may be in the form of a block and may be contained in recess 130 of inner cylinder 8 so as to be able to come into and out of the recess 130 in the same manner as reaming bit 3' with the axial edge of window 136 of sliding tube 135.

According to the above described invention, a drilling system is made possible wherein the bits and reaming bits can be positively fitted to the underground side end of drill pipe 1 therethrough and can be pulled up to the ground surface while leaving drill pipe 1 in the underground as it is.

In the above mentioned embodiment. reaming bit 3' is the same as in FIG. 22.

FIGS. 23 and 24 illustrate the manner of fitting four reaming bits 3' in their respective concave grooves 123 on the outer peripheral surface of inner cylinder 8. Even reaming bits 3' of such shape offer no particular disadvantage in the drilling system according to the present invention. However, as reaming bit 3' functions the same as a reamer in cutting tools for machine tools, it is desirable to increase the number of reaming bits fitted on the peripheral surface of inner cylinder 8 to increase the cutting efficiency.

Therefore, if six reaming bits 3' are fitted to inner cylinder 8 as shown in FIG. 25 by means of pins 64' as are shown in FIGS. 23 and 24, as is evident by comparing FIGS. 24 and 25, mass 145 of the outer surface portion supporting pin 64' will become so small as likely to cause a strength problem. Therefore, in this structure, the number of reaming bits cannot be increased to as many as that shown in FIG. 25.

Therefore, as shown in FIGS. 26 to 28, a semicircular groove 146, facing outwardly of concave groove 123 and extending in a direction at right angles to the center line of inner cylinder 8, is provided at one end of reaming bit 3', and a pin 64'', having a columnar surface 147, is mounted on inner cylinder 8 by means of screws 148 outwardly of both ends of groove 146 so that columnar surface 147 may fit within semicircular groove 146. It can be seen that the surface of reaming bit 3' is in contact with a curved surface 150 of bottom 149 so that reaming bit 3' may rotate at its other end about pin 64''.

Thus, more reaming bits 3' can be mounted at the periphery of inner cylinder 8 without causing strength problems as when reaming bits 3' are mounted with pins 64' shown in FIGS. 23 and 24.

However, reaming bit 3' will be mounted to inner cylinder 8 on only one side surface by pin 64''. Therefore, when expanding a bore by cutting the bore wall with reaming bits 3', the resistance to twisting offered by reaming bits 3' will be reduced. In order to reinforce such resistance, an axial key groove 151 is provided on the surface at the opposite side of groove 146 of reaming bit 3' and on bottom 149 of concave groove 123 opposed to said surface, and a common key 152 is located within key groove 151 to provide a resistance of bits 3' against twisting. A convex and concave extension in the axial direction of inner cylinder 8 may be formed between reaming bit 3' and concave groove 123 instead of using the key and may cooperate with each other.

In the above described embodiment, the present invention is applied to the bit fitting part to be used as locked to the underground side end part of the drill pipe by the locking device so that the reaming bits may be opened and closed as operatively connected with the latch opening and closing mechanism of the locking device. The present invention can be applied also to such structuure of opening and closing the reaming bits by utilizing hydraulic pressure as in FIGS. 1 to 10. It can be applied also to the case of only expanding bore walls without bits or the case of bits for collecting cores (geological samples).

What is claimed is:

1. In a drilling system, comprising a hollow drill pipe located below ground surface and cutting means disposed within said drill pipe, said cutting means having an axial passageway therein through which water is fed at a first predetermined rate of pressure for operating a hydraulic motor which rotates said cutting means during a drilling operation; said cutting means having reaming bits resiliently urged outwardly thereof under said first pressure rate, a pressing piece on said cutting means resiliently urged into engagement with an inner surface of said drill pipe under said first pressure rate for maintaining said cutting means concentrically within said drill pipe, a method of pulling up said cutting means out of said drill pipe, comprising the steps of feeding water through a hollow wire connected to said cutting means and through said axial passageway at a second predetermined rate of pressure lower than said first pressure rate, bypassing the water at said second pressure rate away from said motor and to said reaming bits and said pressure piece for permitting same to move inwardly of said cutting means against the action of said lower second pressure rate, the water being fed out through the underground end of said cutting means so as to avoid any vacuum pressure produced during pulling up and to assist in the pulling up and winding up said wire by a winding means.

2. The method according to claim 1, wherein the water being fed out through said underground end of said cutting means exits through discharge orifices located in said drill bits of such a size as to effect a jetting action.

* * * * *